US006508412B1

(12) United States Patent
Pergay et al.

(10) Patent No.: US 6,508,412 B1
(45) Date of Patent: Jan. 21, 2003

(54) SNOW, ICE PARTICLE GENERATOR, OR NUCLEATION DEVICE, INTEGRATED IN A PRESSURIZED WATER SPRAY HEAD FOR MAKING ARTIFICIAL SNOW

(75) Inventors: Bernard Pergay, Francheville; Patrick Charriau, Rocheserviere; Michel Galvin, Carquefou, all of (FR)

(73) Assignee: York Neige, Carquefou Cedex (FR)

( * ) Notice: Subject to any disclaimer, the term of this patent is extended or adjusted under 35 U.S.C. 154(b) by 0 days.

(21) Appl. No.: 09/601,680

(22) PCT Filed: Feb. 5, 1999

(86) PCT No.: PCT/FR99/00258

§ 371 (c)(1),
(2), (4) Date: Oct. 23, 2000

(87) PCT Pub. No.: WO99/40381

PCT Pub. Date: Aug. 12, 1999

(30) Foreign Application Priority Data

Feb. 6, 1998 (FR) ..... 98 01581
Oct. 23, 1998 (FR) ..... 98 13477

(51) Int. Cl.[7] ..... F25C 3/04
(52) U.S. Cl. ..... 239/14.2; 239/431; 239/434
(58) Field of Search ..... 239/14.2, 431, 239/432, 434, 22

(56) References Cited

U.S. PATENT DOCUMENTS

| | | | | |
|---|---|---|---|---|
| 3,829,013 A | | 8/1974 | Ratnik | |
| 3,964,682 A | * | 6/1976 | Tropeano et al. | 239/14.2 |
| 3,979,061 A | | 9/1976 | Kircher | |
| 4,593,854 A | | 6/1986 | Albertsson | |
| 4,742,959 A | * | 5/1988 | Stanchak et al. | 239/14.2 |
| 4,916,911 A | * | 4/1990 | Duryea et al. | 62/70 |
| 5,102,044 A | * | 4/1992 | Inoue | 239/2 |
| 5,699,961 A | * | 12/1997 | Ratnik et al. | 239/14.2 |

FOREIGN PATENT DOCUMENTS

| | | |
|---|---|---|
| EP | 0 089 590 | 9/1983 |
| WO | WO 97/16686 | 5/1997 |

* cited by examiner

*Primary Examiner*—Lesley D. Morris
*Assistant Examiner*—Dinh Q. Nguyen
(74) *Attorney, Agent, or Firm*—Young & Thompson

(57) ABSTRACT

A nucleation device associated with a spray head and operating by either internal mixing or external mixing. The ratio air/water is not less than 200 and the pressurized water is supplied by the spray head nozzles, which, by simple circulation of water, at the nucleation device, prevents freezing problems. The nucleation device includes a part in the shape of a spray tip for high speed spraying of compressed air and parts in the shape small diameter nozzles for spraying pressurized water into the air stream.

12 Claims, 6 Drawing Sheets

SNOW, ICE PARTICLE GENERATOR, OR NUCLEATION DEVICE, INTEGRATED IN A PRESSURIZED WATER SPRAY HEAD FOR MAKING ARTIFICIAL SNOW

BRIEF DESCRIPTION OF THE INVENTION

This invention concerns an ice or snow particle generator, also called nucleation device or nucleator, integrated in a pressurised water spray head for the production of artificial snow.

DESCRIPTION OF THE RELATED ART

These nucleation devices are practically compulsory when artificial snow is generated using simple water spray heads for rapid seeding and production of snow, i.e. even under limit temperature and humidity conditions.

The nucleation devices or nucleators are devices particularly sensitive to atmospheric conditions and especially to frost.

These nucleators operate moreover with very small water flowrate and are generally supplied by a special system that adjusts the flowrate and the pressure, whereas the said system is branched from the pressurised water supply system to the various nozzles of the spray head.

SUMMARY OF THE INVENTION

This invention suggests a nucleation device that, by its design and its association with the spray head, enables to overcome the shortcomings mentioned above.

It enables to overcome the shortcomings due to atmospheric conditions, such as frost, that clog the flow orifices because of the relatively small cross sections through which pressurised water flows.

It also enables to do away with complicated installations, while simplifying to a vast extent, the means that enable to feed these nucleation devices.

The nucleation device according to the invention comprises means for injecting a small pressurised water jet into an air stream, at high speed, with a very high air/water ratio, and the air-water mixture takes place either internally in a mixing chamber integrated in the spray head or externally, i.e. outside the said head, and whereas these water injection means at least are situated in the said head and are partially immersed in the water system under pressure that supplies the spray nozzle(s) permanently and, simultaneously, the said injection means.

Still according to the invention, the air/water ratio of this nucleation device is at least equal to 200 and the injection of water into the pressurised air stream takes place through one or several orifices of very small cross section, whose diameter is approx. 1 mm or smaller. This particularly small cross section enables to carry out high load loss at the nucleator and especially avoid resorting to any pressure relief system when the pressurised water comes from the supply system of the spray head nozzles. The pressure in this supply system of the nozzles may vary in large proportions, without influencing the operation of the nucleation device.

Still according to the invention, the nucleation device that performs external mixing comprises an air spray nozzle that is fitted with a baffle in order to produce a flat spectrum jet, and it contains a nozzle or tip for water spraying, whose jet strikes the flat air flow with an angle of approx. 45°.

According to an embodiment variation, the nucleation device is in the form of a high-pressure mini snowmaker supplied with compressed air and directly with pressurised water via the supply duct of the spray nozzle(s), whereas the said mini snowmaker is in the form of a cartridge located in the spray head and this cartridge extends between a pressurised air supply duct and the downstream external wall of the said head, while going through at least one pressurised water supply duct to one or several spray nozzles.

Still according to the invention, the mixing chamber of the mini snowmaker is cylindrical in shape and its diameter is slightly greater than the diameter of the end nozzle or tip, which nozzle has an outlet orifice whose section, that is circular or oval, has a diameter equivalent to 10 mm maximum.

According to another embodiment of the invention, the orifice(s) that enable to inject pressurised water into the mixing chamber, comprise a hole leading to the said chamber, whose diameter is approx. 1 mm and whose length is in the same order as the said diameter, whereas the said hole can be provided in the centre of a large diameter bore or countersink, at least ten times the diameter of the said through hole, in order to form a kind of membrane at the inlet of the water jet into the said mixing chamber.

This invention suggests, also in combination with nucleators, a spray head whose capacities can for instance be modified easily according to the requirements.

According to the invention, the spray head, with which the nucleation device is associated, consists of a body which comprises at least two spray nozzles supplied separately with pressurised water, which head comprises a foot that is provided in order to be attached to a post, which post comprises for instance several water supply ducts and possibly pressurised air supply ducts, which ducts are arranged in relation to orifices provided in the said foot in order to supply the various nozzles of the said head.

According to another embodiment of the invention, the body of the spray head consists of a ring-shaped moulded part or other, made of light alloy, which part is fitted with supply chambers for the pressurised water spray nozzles, which chambers are for example obtained directly by a moulding process, whereas each of them is supplied via a duct arranged at the lower portion of the body in order to enable complete drainage of the said chambers when the spray head is inactive, which chambers are moreover adjacent, arranged side by side, offset axially with respect to the axis of the spray jet, and they are each traversed by axial drillings that enable to accommodate the said cartridge-like spray nozzles, which cartridges comprise at least one orifice that leads to one of the chambers, to supply them with pressurised water.

The spray head may thus comprise nozzle sets; each set being supplied by the same chamber.

Still according to the invention, the spray head comprises, upstream of the supply chambers of pressurised water spray nozzles, a chamber supplied with pressurised air, and the cartridge of the nucleation device goes through the various pressurised water chambers and leads at its upstream end to the said pressurised air chamber, which cartridge also contains at least one orifice leading to one of the said pressurised water chambers, and especially the main chamber arranged upstream of the others, to enable injection of water into the air stream that circulates in the said cartridge through the mixing chamber, and this air-water mixture is sprayed by the nozzle of the nucleator in the form of ice or snow.

The spray head with the integrated nucleation device according to a variation of the invention, comprises at least two nozzles supplied separately by distinct pressurised water systems, whereas these nozzles are arranged radially on the periphery of a tubular jacket whose axis is close to the vertical under normal operating conditions, which jacket contains a core that is fitted with radial walls in order to divide, in a watertight manner, the internal space of the said jacket into several chambers:—a main chamber and—at least one secondary chamber that is implemented after the main chamber if necessary, which chambers serve for supplying one or several nozzles, which core is fitted with internal ducts connected to the said pressurised water systems in order to supply each chamber.

Still according to the invention, the upper portion of the spray head comprises a cap fitted with at least one nucleation device provided beside or in the vicinity of the nozzle(s) of the main chamber, which device is supplied with pressurised water and with pressurised air, whereas pressurised water is supplied via the supply duct of the said main chamber, which duct goes through the said cap and whereas air is provided by a specific duct arranged in the core and in the cap, in the centre of the said core and cap.

Still according to the invention, the nucleation device is integrated radially in the head, going through the tubular jacket and is shrink-fitted in the centre core to reach the pressurised air supply duct.

According to a variation, the nucleation device comprises a cartridge making up the mixing chamber and two spray nozzles for the air-water mixture, whereas each nozzle is oriented parallel to the faces of the dihedra in which for instance the pressurised water spray nozzles are aligned.

In the various cases above, the body of the nucleation device is partially immersed in the water circulating in the main chamber, thereby preventing the small orifice(s) from being frozen up or clogged, thanks to permanent circulation of water in the said chamber.

According to another provision of the invention, still with a view to avoiding frost phenomena at the head, the various supply ducts of the chambers of the said head lead to the lower portion of each chamber thereby ensuring complete drainage of the said chambers once the installation has stopped.

BRIEF DESCRIPTION OF THE DRAWINGS

The invention will also be detailed using the following description and the appended drawings given for exemplification purposes and on which.

DESCRIPTION OF THE PREFERRED EMBODIMENTS

Figures 1, 2, 3, 4, 5:
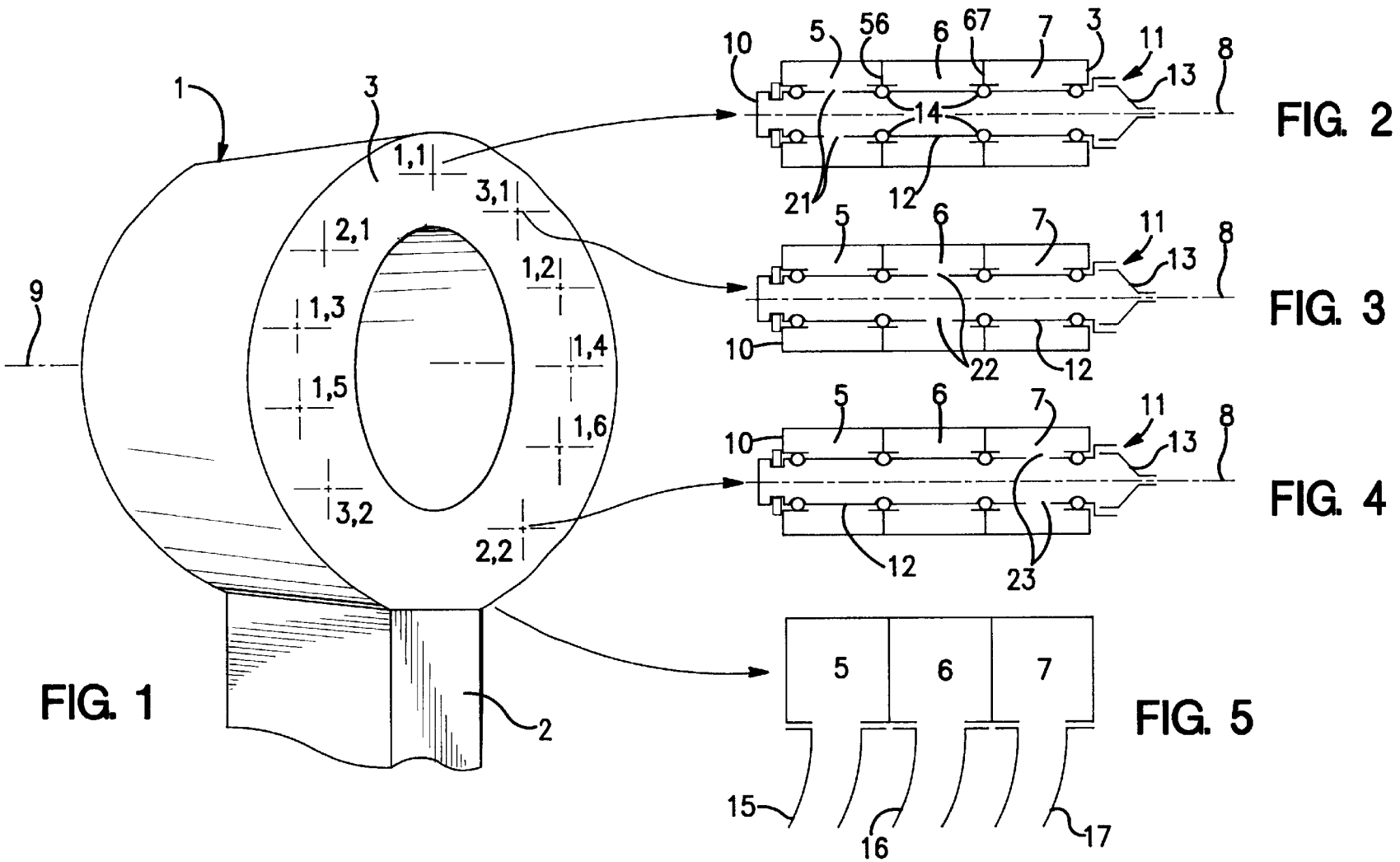
FIG. 1 represents schematically, an embodiment of a spray head liable to be associated with a nucleation device according to the invention.
FIG. 2 represents schematically and simply functionally, a portion of the body of the spray head and the implantation of a cartridge serving as a spray nozzle, supplied by the chamber upstream of the said body.
FIG. 3 represents, as for FIG. 2, a schematic section of the body of the spray head, with a cartridge serving as a nozzle provided to co-operate with the central chamber.
FIG. 4 represents as previously, a cartridge serving as a spray nozzle, co-operating with the chamber downstream of the body.
FIG. 5 represents the supply of the various chambers of the body of the spray head.

The spray head may be, as shown on FIG. 1, in the form of a ring-shaped sleeve 1 carried by a base or foot 2. This head comprises on its downstream face 3, several orifices represented by crosses. The water that arrives as pressurised at these orifices, is sprayed axially.

This spray head 1 is arranged to accommodate at the orifices mentioned above, several sets of spray nozzles, such as for instance the set number 1 that comprises nozzles marked as 1.1, 1.2, 1.3 . . . etc., up to 1.6, as well as a set number 2 marked 2.1, 2.2, for example and a set number 3 marked 3.1, 3.2.

Each set 1, 2, 3 is supplied with pressurised water in a distinct fashion, according to features particular to each set.

Thus, a large variety of sprays can be obtained in terms of flowrate, notably, suited to all requirements, from the same head.

To provide this versatility, the head 1 and especially its body, comprise several chambers as represented on FIGS. 2 to 5, each chamber serving to supply a set or series of spray nozzles.

FIGS. 2 to 5 show, schematically and in a simply functional fashion, a portion of the body of the spray head. This ring-shaped body, FIG. 1, can be rectilinear or otherwise as for instance in the form of a tuning fork; it has several chambers and in particular three chambers on the examples detailed on FIGS. 2 to 5. This, there is an upstream chamber 5 making up the main chamber, a central chamber 6 and a downstream chamber 7.

These chambers are arranged side by side, separate by walls 56 for the adjacent chambers 5 and 6, and 67 for the chambers 6 and 7.

These various chambers are drilled along an axis 8 that is oriented parallel to the axis 9 of the spray head. This bore goes through the downstream wall 3, the walls 56 and 67 and, as represented on FIGS. 2 to 4, the upstream wall 10 of the body of the head.

This drilling enables to accommodate a spray nozzle 11 in the form of a cartridge 12 closed at its upstream end and fitted with a tip 13 at its downstream end.

Tightness between the cartridge 12 and the different walls of the chambers and of the body of the head 1 is provided using joints 14. The cartridge 12 is immobilised by any appropriate means on the body 1.

The spray nozzle 11 represented on FIG. 2 is a nozzle that corresponds to the set number 1. This nozzle communicates with the chamber 5 that receives pressurised water, as represented on FIG. 5, via a supply duct 15.

Similarly, ducts 16 and 17 supply the chambers 6 and 7 separately and respectively.

This chamber 5, 6 or 7 can therefore be used to supply the different sets of nozzles.

Thus, as represented on FIG. 2, the chamber 5 supplies the nozzles of the set number 1. The cartridge 12 comprises to that effect one or several orifices 21 that enable communication of the chamber 5 with the nozzle, whereas water is ejected through the tip 13.

FIGS. 3 and 4 represent, as on FIG. 2, a portion of the chambers 5, 6 and 7, as well as nozzles 11.

FIG. 3 shows a nozzle 11 whose cartridge 12 comprises orifices 22 that enable to put the said nozzle in communication with the chamber 6 for spraying the pressurised water through the tip 13.

FIG. 4 shows the nozzle 11 and especially its cartridge 12 fitted with orifices 23 that put the said nozzle in communication with the chamber 7.

FIG. 1 illustrates, for a first embodiment, a spray head that contains a body in the form of a ring-shaped sleeve fitted with a foot 2. The body and the foot 2 are preferably moulded as a single block, of light alloy. The chambers 5, 6 and 7, which are annular in shape, can be obtained directly by a moulding process.

The foot 2 comprises the ducts corresponding to the tubes 15, 16 and 17 represented on FIG. 5. This foot 2 is also arranged to be attached for instance to a post 25 as that described in the document mentioned above FR-2.743.872.

Figure 6:
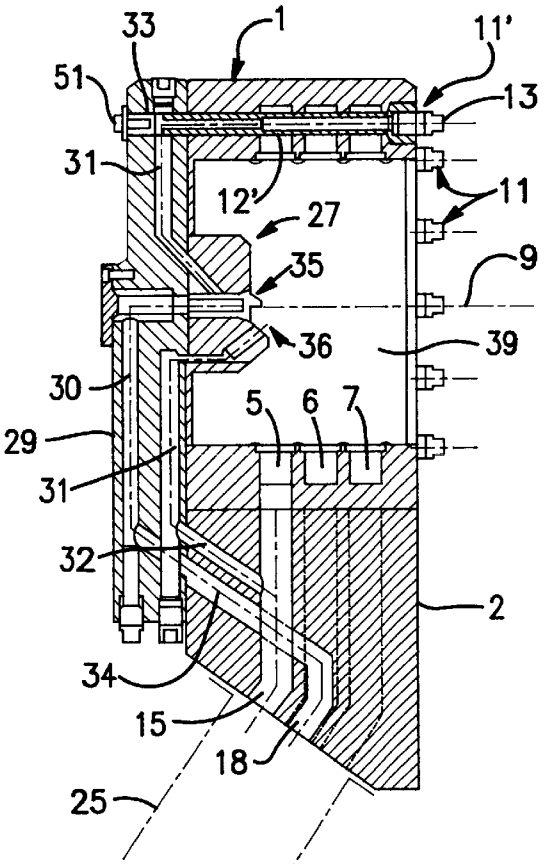
FIG. 6 represents a top view of a longitudinal and vertical section of a spray head according to a first embodiment of the nucleation device according to the invention

This post 25, shown as a thin mixed line on FIG. 6, comprises tubular sections obtained for example directly by extrusion, whereas these tubular sections enable to supply with pressurised water the chambers of the spray device and, moreover, thanks to a central ductwork, to supply with pressurised air, a nucleation device or nucleator.

Figure 8:
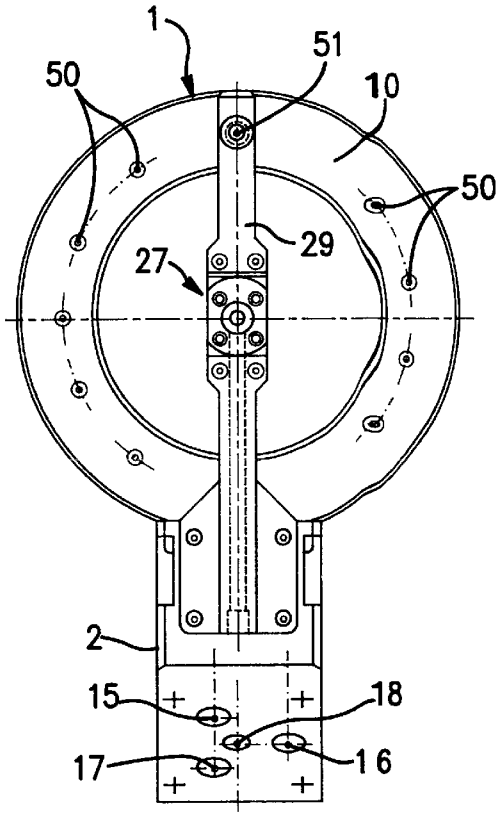
FIG. 8 represents a rear view of the spray head represented on FIGS. 6 and 7.

The distribution of the pressurised water supplies is shown on FIG. 8 with, in the centre, the inlet orifice of the duct 18 for the air to flow. This duct 18 serves for supplying with pressurised air the nucleation device 27 that is represented as a cross section on FIG. 6 and in a more detailed fashion on FIG. 9.

This nucleation device comprises a support 29 in the form of a vertical bar centred on the middle vertical plane of the spray head and attached to the upstream inlet of the said head. This support 29 comprises a duct 30 that is used for the passage of the pressurised air and a duct 31 that is used for the passage of the pressurised water, whereby the said duct 31 is supplied via a branch 32 or tap on the supply duct 15 of the chamber 5 making up the main chamber.

The duct 31 extends also at the upper portion of the support 29 and it enables to supply a particular nozzle 11' going through the chambers 5, 6, 7 and the upper portion of the support 29. This nozzle 11' is in the form of a cartridge also mounted in a watertight fashion in the body 1 and this nozzle 11' is fitted, at the duct 31, with orifices 33 that enable passage of the pressurised water to the spray tip 13.

Thus, water can circulate inside the support 29 and, as detailed below, in the nucleator 27 properly speaking, which prevents any freezing, let alone enables defrosting of the water and/or air jet of the said nucleator when putting the installation into service or during its operation.

The duct 30 provided in the support 29 communicates with the duct 18 that transports the pressurised air.

Figure 9:
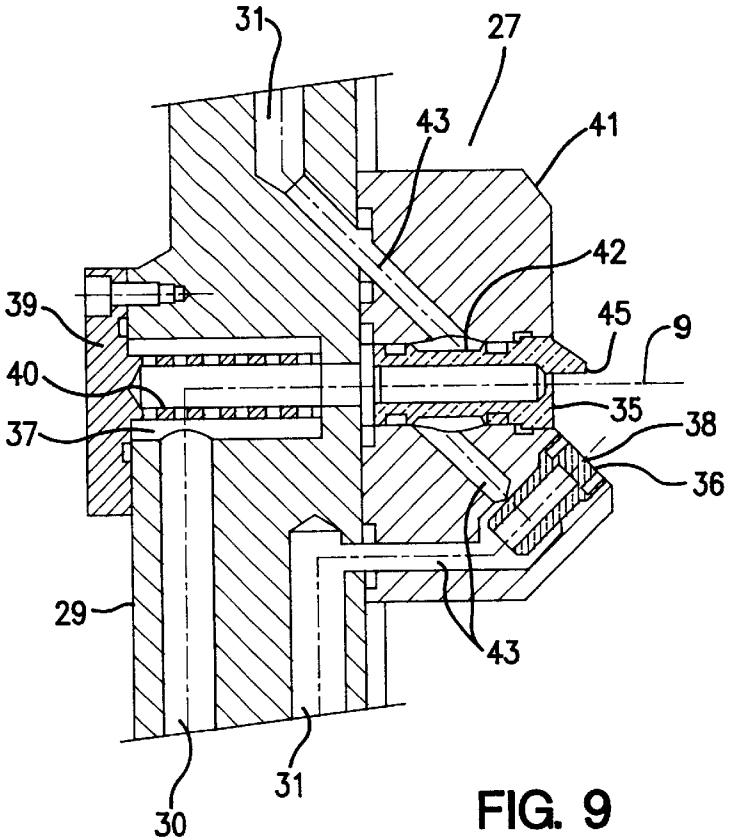
FIG. 9 represents in a more detailed fashion, the nucleation device arranged upstream of the body of the spray head as represented on FIGS. 6 to 8.

FIG. 9 shows in a more detailed fashion, the nucleator 27 properly speaking. This nucleator comprises in the example represented, a central tip 35 that sprays the pressurised air supplied by the duct 30, and a tip 36 to spray the water that is supplied as pressurised by the duct 31.

It can be noted that the pressurised water arrives at a chamber 37 provided in the support 29 and centred on the axis 9 of the spray head. This chamber 37 is clogged by a cap 39 attached to the rear, i.e. upstream of the support 29 and this cap carries a filter 40 that is interposed between the duct 30 and the tip 35.

The tip 35 is mounted on a drilled block 41 that is attached on the downstream face of the support 29. This block 41 comprises an axial cavity centred on the axis 9 to accommodate the tip 35 and it can be seen that a chamber 42 is provided around the tip 35, substantially halfway up, whereas the said chamber 42 communicates with ducts 43 that enable the ducts 31 arranged in the lower portion and in the upper portion of the support 29 to join up. These ducts 43 provide for continuous water circulation in the drilled block 41, around the tip 36 and around the tip 35.

The tip 35 is of the type fitted with a baffle 45 that provides a flat jet. This flat air jet is struck by water jet from the tip 36. This tip 36 is indeed arranged below the tip 35, with an angle of approx. 45° with the axis 9 of the jet 35. While striking the air jet, the water jet is transformed into ice or snow particles that will seed the streams from the various nozzles 11 and 11' in operation.

The orifice 38 of the tip 36 is very small in diameter, less than 1 mm. This tip 36 is partially immersed in the water that circulates to supply the spray nozzle 11', which prevents the orifice 38 from freezing up and being clogged.

Moreover, this orifice 38, thanks to its very small size, enables to obtain regular jet, whatever the pressure in the supply system of the spray nozzle 11'.

The above nucleation device is of the external mixing type, i.e. water and air are mixed outside the spray head, but in the central cavity 39 of the body and upstream of the spray nozzles 11. The air-water mixing takes place with a very high ratio, at least equal to 200.

Figure 7:
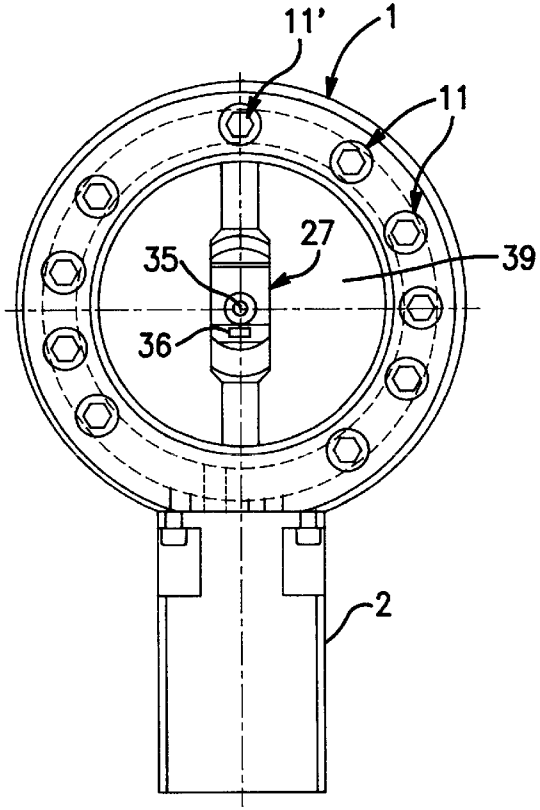
FIG. 7 represents a front view of the spray head represented on FIG. 6.

FIG. 7 shows the different spray nozzles 11 distributed on the downstream face 3 of the body of the head as well as the spray nozzle 11' arranged at the upper portion on the middle vertical plane. The tips of these different arrangements are for instance flat spectrum tips, provided on planes parallel to one another in order to form strata.

On the middle vertical plane, the tip 35 is arranged in the centre of the spraying device as well as the tip 36 that generates a pressurised water jet into the air jet from the tip 35.

The different nozzles 11 and the nozzles 11' generate and induce an air stream in the body of the head 1 and around the said body, promoting the water/air mixing for the production of snow.

FIG. 8 shows, seen from the rear, the spray head fitted with the nucleation device 27.

The upstream face of the body of the head comprises the various screws 50 that enable assembly of the nozzles 11 and in particular assembly of the cartridges 12 making up the said nozzles.

The nozzle 11' is attached using a screw 51 that is shown on FIGS. 6 and 8.

Figure 10:
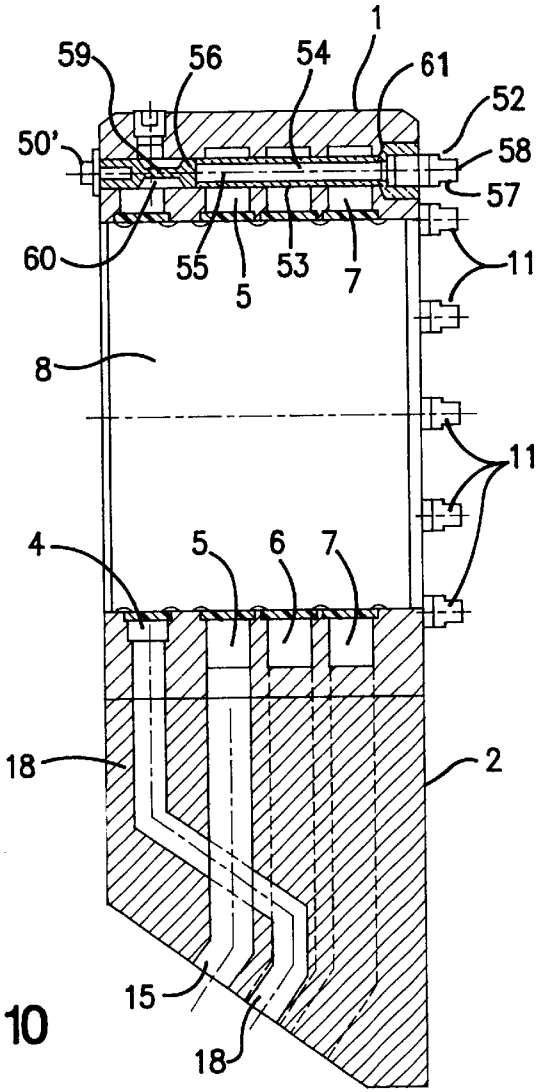
FIG. 10 represents an implantation variation of the nucleation device in the spray head, which nucleation device is in the form of a high-pressure type mini snowmaker.

FIG. 10 represents an embodiment variation on which the nucleator is directly integrated in the body of the spray head. This nucleator is in fact in the form of a particular cartridge, as a high-pressure mini snowmaker, arranged at the upper portion of the body of the head 1.

The body comprises on top of the chambers 5, 6 and 7 that are supplied with pressurised water, a chamber 4 arranged upstream of the previous chambers, also ring-shaped, and that is supplied with pressurised air via the duct 18 that is provided in the foot 2 and communicates with the said chamber 4.

The result is therefore a spraying device that is particularly compact and homogeneous, which accommodates a nucleator consisting of a mini snowmaker 52 and conventional spray nozzles 11 distributed on the downstream face 3 of the body of the head according to several sets, whereas each of these sets is supplied using the chambers 5, 6 or 7 in relation to the requirements with of course every possibility to realise a kind of combined selection of the nozzles.

The nozzle or mini snowmaker 52 comprises a cartridge 53 that goes through the chambers 5, 6 and 7 in a watertight fashion.

This cartridge 53 is fitted with an axial cavity serving as a mixing chamber 54 and its wall is drilled with at least one orifice 55 situated in the chamber 5, which chamber is supplied with pressurised water. The cartridge 53 is thus partially immersed in the water supply of the nozzles 11, which prevents the orifice(s) 55 from freezing up.

The orifice(s) 55 have together a portion that matches or is even smaller than the circular section of an orifice whose diameter would be approx. 1 mm. The load loss caused by this (these) orifice(s) enables operation of the nucleator whatever the water pressure in the chamber 5 notably.

The upstream wall of the mixing chamber 54 comprises orifices 56 to enable passage of the pressurised air from the chamber 4.

The water-air ratio mixing takes place in the chamber 54 and comes out through the tip or nozzle 57. It is a very high water-air ratio, at least equal to 200.

The upstream end of the cartridge 53 is in the form of a central rod 59 at the duct 60 that puts the chamber 8 in communication with the chamber 54 of the mini snowmaker.

Upstream of the rod 59, the assembly screw 50' enables attachment of the cartridge 53 making up the mini snowmaker 52, on the body 1 thanks to the shoulder 61 located at the downstream portion of the said cartridge. This shoulder can also be found, identical, on the cartridges 12 detailed previously.

Figure 11:
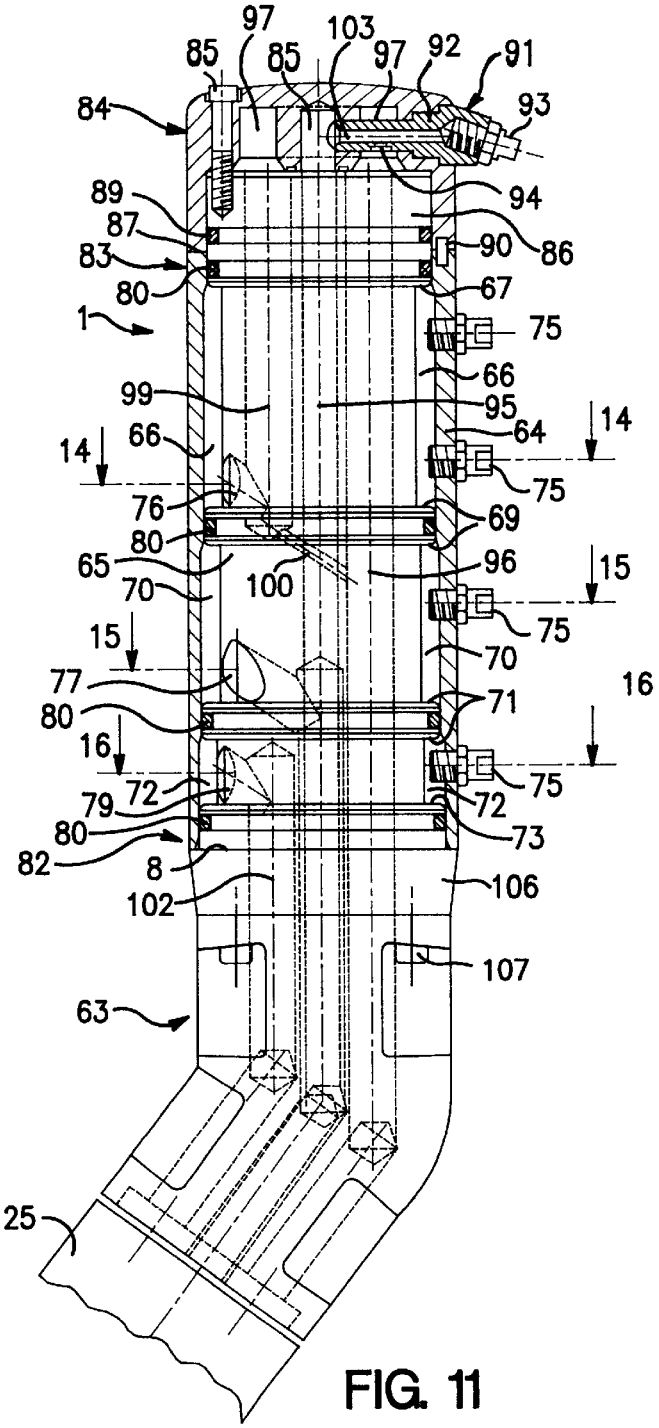
FIG. 11 represents an embodiment variation of the spray head according to the invention with a vertical and axial section of the nucleation device.

The spray head represented on FIG. 1 and FIG. 11 is more especially designed for attachment as well at the end of a post as in the installation described in the patent FR-2.743.872 of the applicant.

Between the spray head 1 properly speaking and the upper end of the mast 25, a part 63 can be used as an intermediate part, as represented on FIG. 11. This part 63 is slightly bent in order to tilt the head 1 favourably, close to the vertical, or slightly tilted in order spray the water at an angle promoting projection over the greatest possible distance in relation to the requirements and to the site.

The head 1 on FIG. 11 consists of a tubular jacket 64 and a cylindrical core 65 centred in the said jacket and whose diameter is smaller than that of the said jacket to allow passage of the pressurised water. The core 65 comprises circular radial walls that divide the internal space between the jacket 64 and the said core, into several chambers.

Thus, this embodiment comprises the following:—a main chamber 66, at the upper portion of the spray head, delineated by the walls 67 and 69 of the core 65,—an intermediate chamber 70 delineated by the walls 69 and 71 and a lower chamber 72 delineated by the walls 71 and 73. The wall 73 is situated at the lower portion of the core 65 and the wall 67 at the upper portion.

Each chamber supplies one or several tips 75 positioned on one or several generators of the cylindrical shell of the jacket 64.

The chamber 66 making up the main chamber may comprise several tips 75 distributed over several generators.

The tips 75 of the chambers 70 and 72 are complementary tips that are implemented independently from those of the chamber 66, in relation to the climatic conditions to increase, according to the said climatic conditions, the quantities of snow produced.

Each chamber is supplied with a duct that opens at its lower portion.

It can be seen on FIG. 11 that the orifice 76 leads to the chamber 66 at its lower portion, i.e. at the wall 69 of the core 65. An orifice 77 leads to the lower portion of the chamber 70 at the wall 71, and an orifice 79 leads to the chamber 72 at the wall 73.

Tightness between the jacket 64 and the different walls 67, 69, 71 and 73 is ensured using O-rings 80 provided in the thickness of the said walls.

The lower portion of the core 65 comprises a skid 81 in the form of a radial shoulder, on which rests the lower end 82 of the jacket 64. The core 65 extends above the upper end 83 of the jacket 64 and it is covered by a cap 84 that is fixed by screws 85 captive in he upper cylindrical end 86 of the core 65. The joining plane 87 between the jacket 64 and the cap 84 is arranged between the O-ring 80 of the wall 67 and an O-ring 89 provided in a groove arranged in the upper cylindrical end 86 of the core 65.

The cap 84 is positioned with respect to the core 65 accurately either using an original distribution of the screws 85 and/or a centring pin 90.

This position of the cap 84 enables putting the jacket 64 in an accurate position also using the centring pin 90 interposed between both items at the joining plane 87.

The cap 84 comprises at least one nucleation device 91 that serves as a nucleator, to generate ice or snow particles that will then seed the different jets from the tips 75 of the spray head. This nucleation device 91 comprises a cylindrical body in the form of a cartridge 92 inserted radially in an orifice provided to this end in the cap 84, and a nozzle or tip 93 that is preferably oriented to the jets of the different nozzles or tips 75 for the seeding operation.

The cartridge 92 of the nucleation device is fixed by any appropriate means in the cap 84, for instance screwed; a detailed description follows.

The tips 75 are supplied with pressurised water from the ducts that feed the pressurised water to the different chambers. The distribution of these ducts in the core 65 is shown on the various sections represented on FIGS. 14 to 16 and, as a dotted line on FIG. 11.

The nucleation device 91 making up in fact a kind of high-pressure mini snowmaker with very high water/air ratio, at least equal to 200, is supplied with pressurised water using one of the supply ducts of the chambers and in particular via the duct feeding the main chamber 66.

This mini snowmaker is also supplied with pressurised water. It can be seen on FIGS. 14 to 16 and FIG. 11 that a duct 95 is arranged in the centre of the core 65, that extends into the cap 84, as a central blind hole. This duct 95 enables to feed the pressurised water to the nucleation device 91 and especially to the downstream inlet of the mixing chamber of the said device, detailed below.

The chamber 66 is arranged just below the nucleation device 91; it is supplied with pressurised water via a duct 96 that also extends into the cap 84, whereas the said cap comprises a ring-shaped cavity 97 traversed by the cartridge 92 of the nucleation device 91. Thus, the duct 96 extends over the whole length of the core 65; it communicates with the ring-shaped cavity 97 provided in the cap 84 and a second duct 99 provided in the core 65 extends from the said cavity 97 of the cap 84, to the lower portion of the chamber 66, leading, at the orifice 76, to the said chamber in order to feed the latter.

Figure 14:
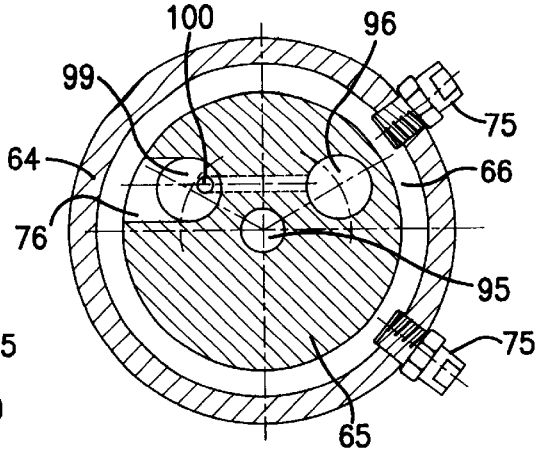
FIG. 14 represents the cross section of the head along the line 14—14 of FIG. 11.

It can be seen on FIGS. 11 and 14 that the chamber 66 feeds several tips 75, arranged in pairs on two different generators. These tips 75 are aligned vertically with the tips arranged at the other chambers 70 and 72 and also with the nucleation devices 91.

As indicated previously, the orifice 76 is situated at the lower portion of the chamber 66. It can be seen, in the continuation of this orifice 76, a little duct 100 of small diameter extends between the duct 99 and the duct 96, arranged in such a way that it enables complete drainage of the water situated in the chamber 66, once the water supply has been turned off.

The diameter of this duct 100 is approx. one fifth of the diameter of the ducts 96 and 99 in order to preserve preferential circulation of the pressurised water in the cavity 97 of the cap 84.

Figure 15:
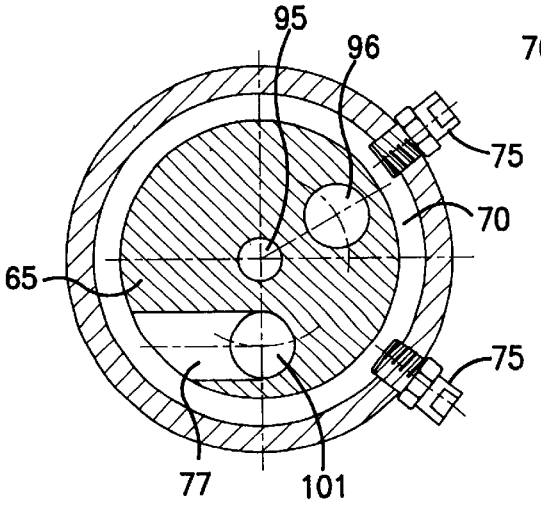
FIG. 15 represents the cross section of the head along the line 15—15 of FIG. 11.

FIG. 15 shows a cross section at the orifice 77 that enables to feed the chamber 70 and the tips 75. This orifice 77 is supplied using a duct 101 extending axially in the core 65.

FIG. 15 also shows the duct 95 arranged at the centre of the core inside which the compressed air circulates, and the duct 96 that is used to feed the chamber 66 and simultaneously, to feed the nucleation devices 91 while ensuring all around these nucleation devices, constant water circulation to prevent any frost.

Figure 16:
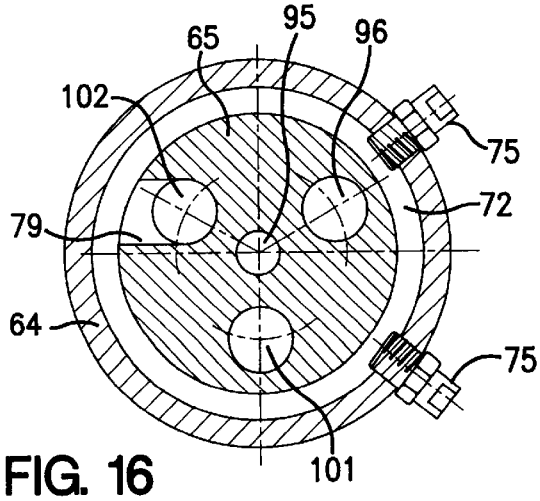
FIG. 16 represents the cross section of the head along the line 16—16 of FIG. 11.

FIG. 16 corresponds to a cross section at the orifice 79 that is used to supply the chamber 72 and the lower tips 75. This chamber 72 is fed via a duct 102 extending parallel to the duct 101, the duct 96 and the central duct 95 that is used for letting the compressed air through.

It can be seen that the duct 102 is located below the duct 99, centred practically on the same axis. The lower end of the duct 99 and the upper end of the duct 102 are separated by a distance that corresponds substantially to the height of the chamber 70.

Figure 12:
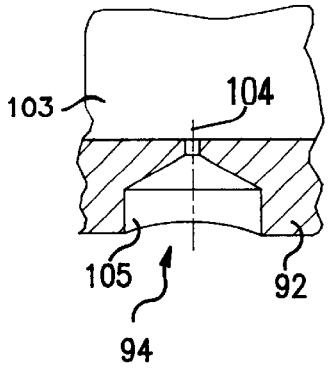
FIG. 12 represents in a detailed and enlarged fashion, a pressurised water supply orifice in the mixing chamber of the nucleation device.

FIG. 12 shows the detail of one of the pressurised water inlet orifices into the cartridge 92 of the nucleation device 91.

This cartridge 92, ring-shaped, comprises in its central portion an axial chamber 103 that leads downstream of the nozzle 93 and that is open upstream on the duct 95 in the cap 84.

The diameter of the axial chamber of the mixture 103 is substantially greater than the diameter of the outlet tip 93. The pressurised water that is used to feed the main chamber 66, is injected in a radial fashion into the mixing chamber 103 via orifices 94, preferably three orifices distributed at the periphery of the cartridge 92, whose jets can be concurrent on the axis of the said mixing chamber.

These orifices 94, one of which is represented as a cross section and enlarged on FIG. 12, are situated rather upstream of the mixing chamber 103.

As represented on FIG. 12, the external wall of the cartridge 92 is drilled radially with a first hole 104 whose diameter is smaller than 1 mm, and a second hole or countersink 105 with much greater diameter. The diameter of the hole 105 is in the order of ten times the diameter of the hole 104. The length of the hole 104 is similar to its diameter. Thus, the pressurised water is injected into the mixing chamber 103 while passing through a kind of membrane that enables the nucleation device 91 to operate whatever the pressure of the water injected into the main chamber 66 to supply the tips 75.

For exemplification purposes, the nucleation device may exhibit the following features: for an outlet at the tip 93 in the order of 5.2 mm, the diameter of the mixing chamber 103 will be approx. 7 mm and each of the three orifices 104 will be approx. 0.6 mm in diameter.

The operation of this nucleation device 91 is similar to a high-pressure type mini snowmaker, in which the air/water ratio is very important, at least equal to 200 and preferably vastly greater.

The spray head 1 and in particular the skid 106 of the core 65 is attached using screws 107 to the intermediate fitting 63, which fitting 63 is itself attached using screws that are not represented, to the end of the mast 25.

Figure 13:
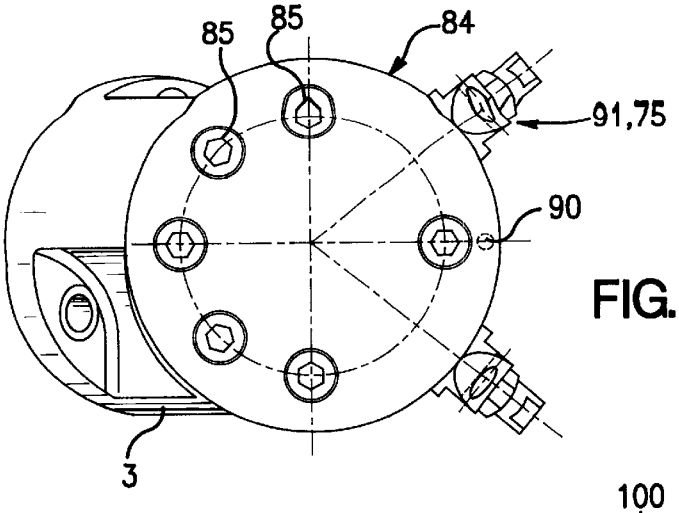
FIG. 13 represents a top view of the spray head.

FIG. 13 shows the distribution of the screws 85 that enable fastening the cap 84 to the upper end of the core 65. The distribution of the screws is such, as mentioned previously, that it causes accurate orientation of the head with respect to the core 65 and, consequently, an orientation that is also defined for the jacket 64 that carries the tips 75, using the centring pin 90 interposed between the said jacket and the said core.

Figure 17:
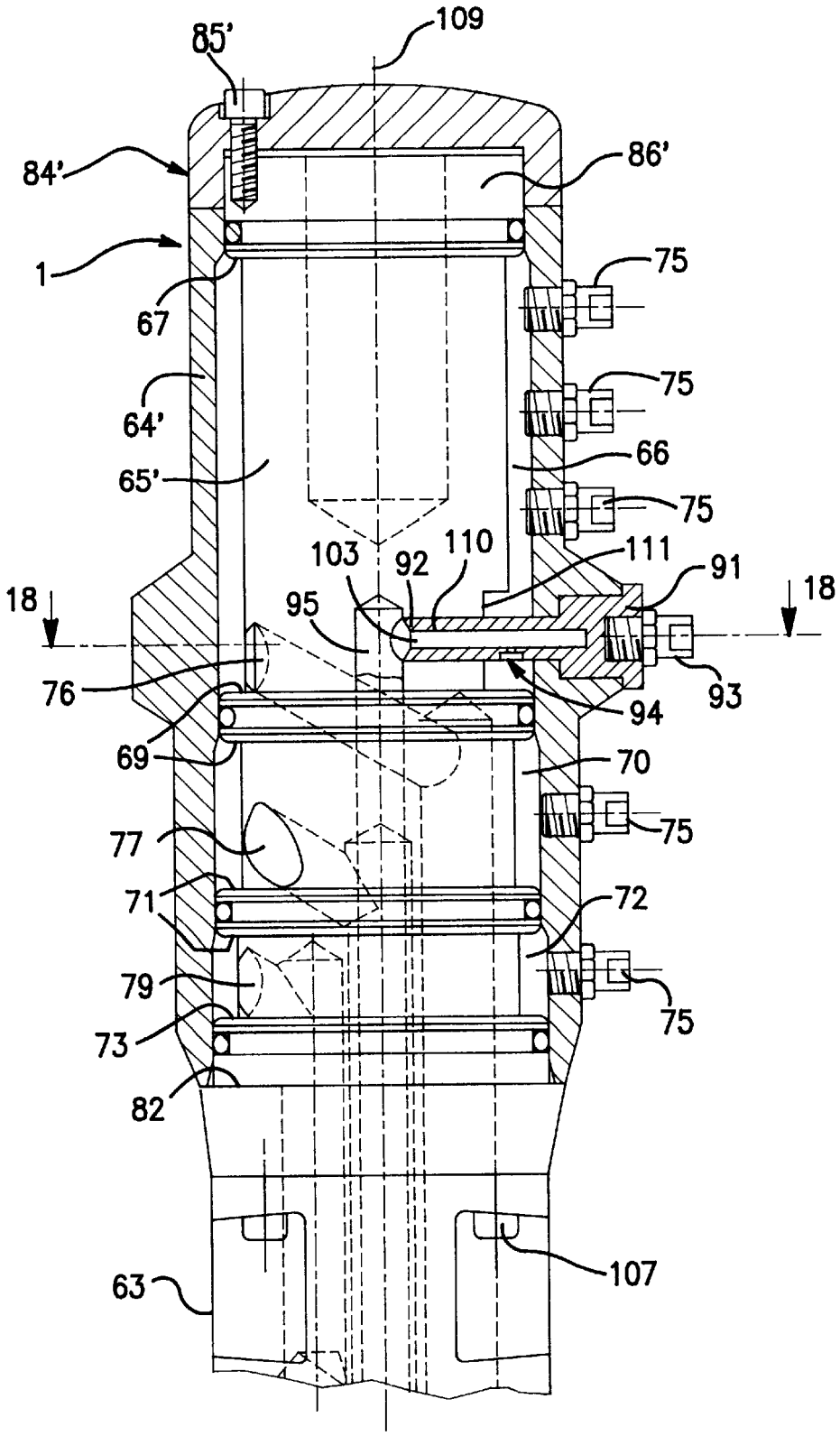
FIG. 17 represents a variation of the spray head represented on FIG. 11, as a vertical cross section going through the nucleation device.

FIG. 17 represents a variation of the spray head represented on FIG. 11.

This variation shows the same arrangement of the chamber 66, 70 and 72. Simplification appears clearly with the implantation of the nucleation devices 91 that are integrated directly at the lower portion of the chamber 66.

This FIG. 17 shows a portion of the intermediate part 63 to which the core 65' is attached. The core 65' is in the form of a moulded and machined part, of light alloy, and looks like a kind of hydraulic drawer threaded into a shell 64'. This shell 64' consists itself of a machined moulded part, of light alloy, maintained between the lower shoulder 81 at the core and the cap 84' that is attached by screws 85' at the upper end 86' of the core 85'.

The chambers 66, 70 and 72 are, as previously, arranged between walls. Thus, the upper wall 67 that delineates the ring-shaped chamber 66 with the wall 69, can be seen.

The ring-shaped chamber 70 is delineated by the wall 69 and the wall 71. This wall 71 is interposed between the chamber 70 and the chamber 72, which ring-shaped chamber 72 is delineated at its lower portion by the wall or shoulder 73.

To simplify assembly, the walls can be with slightly increasing diameters from the end of the core up to its skid 81.

These chambers are fed as previously for the head represented on FIG. 11, by ducts that are shown with a thin mixed line and that lead through a radial drilling to the lower portion of each of the said chambers. These radial drillings are besides tilted in order to allow efficient and complete drainage of each of the chambers to prevent any frost once the spraying has stopped.

Thus the orifice 76 that enables injecting the pressurised water into the chamber 66 can be seen. This injection into the chamber 66 takes place directly at the lower portion without going through, as previously on FIG. 11, through the cap 84.

The chamber 70 is supplied via the orifice 77 and the chamber 72 is supplied via the orifice 79.

A central duct 95, in the core 65', enables to bring the pressurised air to the nucleation device 91. This nucleation device is as shown previously on FIG. 11, in the form of a cartridge 92. This cartridge 92 goes through the wall of the shell 64', in a watertight fashion, and it is for example screwed to this wall; it is shrink-fitted in an orifice 110 arranged radially in the core 65', which orifice leads to the pressurised air supply duct 95.

Thus, the nucleation device is supplied with pressurised air at the upstream end of its mixing chamber 103, and the pressurised water is supplied via one or several orifices 94 provided in the wall of the cartridge 92.

These orifices 94 are situated in the chamber 66, supplied with pressurised water at the same time as the spray nozzles 75.

The cartridge 92 of the nucleation device 91 is partially immersed in the water that circulates in the chamber 66, which prevents the holes which inject water into the mixing chamber 103 from being frozen up or clogged.

Figure 18:
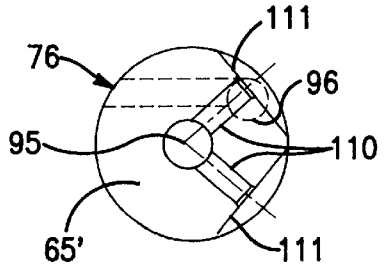
FIG. 18 represents a section along the line 18—18 of FIG. 17.

As represented on FIG. 18, two nucleation devices 91, delineating an angle close to 90° to one another, can be positioned. These nucleation devices are arranged at the lower portion of the main chamber 66, each beneath a vertical row of spray nozzles 75, which nozzles are represented as three in number on FIG. 17, on the same line and on the same vertical plane.

This vertical plane, that comprises a nucleator 91 and the nozzles 75 of the main chamber 66, also carries the spray nozzles 75 associated with the chambers 70 and 72 situated below the main chamber 66.

It should also be noted that the nucleation devices 91 are used to position the shell 64' of the spray head at a certain angle with respect to the core 65' because they are shrink-fitted in radial cavities of the said core.

The tip 93 of the nucleation device 91 is oriented like all the tips 75, perpendicular to the longitudinal axis 109 of the head 1. It is arranged beneath the tips 75 of the main chamber 66 and not above as in the case of the head represented on FIG. 11.

FIGS. 17 and 18 show that the core 65' comprises a countersink 111 at each orifice 110 in which the cartridge 92 of the nucleation devices 91 is shrink-fitted.

These countersinks enable to obtain good circulation of the water around the cartridge 92 of the nucleation devices 91.

The orifices 94 of the nucleation devices represented on FIG. 17 correspond to the orifices 94 represented on FIG. 12 in connection with FIG. 11.

Figure 19:
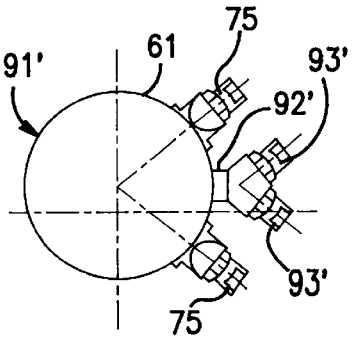
FIG. 19 represents a variation of a nucleation device fitted with two nozzles, common to two rows of spray nozzles.

FIG. 19 shows an embodiment variation as regards the assembly of the nucleation device on the spray heads in the form of columns represented on FIGS. 11 and 17.

The nucleation device 91' comprises a cartridge 92' that is fitted with two nozzles or tips 93'. The cartridge is centred on the middle plane of the dihedron formed by both rows of spray nozzles 75 whereas the tips 93' are oriented parallel and with respect to each face of the said dihedron.

This particular arrangement enables to seed with a single nucleator, which nucleator comprises, in such cases, orifices 94 in the cartridge 92', to inject water, what are substantially higher than those in the previous assemblies. This reduces still further the risks of the orifices 104, notably, being frozen up and clogged.

What is claimed is:

1. A nucleation device associated with a water spray head that is fitted with at least one high-pressure water system supplied spray nozzle, for the generation of artificial snow, characterized in that it comprises pressurized injection means of a small water jet into an air stream at high speed, with very high air/water ratio, at least equal to 200, which mixture takes place internally in a mixing chamber integrated in the spray head, and whereas these water injection means at least are situated in the said head and are partially immersed in a supply water system that supplies the spray nozzle(s), which system supplies simultaneously the said injection means.

2. A nucleation device according to claim 1, characterised in that the injection of water into the air stream takes place through one or several orifices of very small cross section, whose diameter is approx. 1 mm.

3. A nucleation device of the external mixing type according to claim 1, characterised in that it comprises a compressed air spray nozzle (35) that is fitted with a baffle in order to produce a flat spectrum jet, and it contains a nozzle or tip (36) for water spraying, whose jet strikes the flat air flow with an angle of approx. 45°.

4. A nucleation device of the internal mixing type according to claim 1, characterized in that it is in the form of a high-pressure mini snowmaker, comprising a cartridge located in the spray head across a wall of the spray head, which cartridge comprises a mixing chamber (54, 103) whose upstream end leads to a pressurized air supply duct or chamber (60, 95) and extends downstream to tips (57, 93) of said nucleation device and to the wall of the spray head, with between both at least one orifice (55, 94) for injecting water into the said chamber, which orifice (94) is situated in the supply water system of the spray nozzle(s) (11, 75) of the said head.

5. A nucleation device according to claim 4, characterised in that the mixing chamber (54, 103) is cylindrical in shape and its diameter is slightly greater than the diameter of the end nozzle or tip (57, 93), which nozzle has an outlet orifice whose global section has a diameter equivalent to 10 mm maximum.

6. A nucleation device according to claim 5, characterized in that the orifice(s) (94) that enable to inject pressurized water into the mixing chamber (103), comprise a hole (104), whose diameter is lower than 1 mm and whose length is in the same order as the said diameter, and, upstream of this hole (104) one hole (105) whose diameter is approx. ten times the diameter of the said hole (103) thereby forming a kind of membrane at the inlet of the mixing chamber.

7. A nucleation device according to claim 1, characterised in that it is integrated in a spray head (1) consisting of a body which comprises at least two spray nozzles (75) supplied separately with pressurised water, which head comprises a foot (2, 63) that is provided in order to be attached to a post (25), which post comprises for instance several water supply ducts and one pressurised air supply duct, which ducts are arranged in relation to orifices provided in the said foot in order to supply the various nozzles of the said head.

8. A nucleation device according to claim 7, characterised in that the nozzles (75) are provided on the body of the spray head, which body consists of a moulded part of light alloy, which part is fitted with supply chambers for the said spray nozzles, which chambers (5, 6, 7) are obtained directly by a moulding process or other and are adjacent, arranged side by side, offset axially and each traversed by axial drillings that enable to accommodate the said cartridge-like spray nozzles (11), which cartridges comprise at least one orifice that leads to one of the said chambers, to supply them with pressurised water.

9. A nucleation device according to claim 8, characterised in that the spray head comprises, upstream of the chambers (5, 6, 7), a chamber (4) supplied with pressurised air and in that the cartridge (53) making up the mini snowmaker goes through the different chambers (5, 6, 7) in a watertight fashion, which cartridge leads at its upstream end to the said chamber (4) and comprises at least one orifice (55) that leads to one of the chambers (5, 6, 7) and in particular to the main chamber (5) to enable injection of pressurised water to the air stream that circulates at high speed in the mixing chamber (54).

10. A nucleation device according to claim 7, characterised in that the nozzles (75) are arranged radially on the periphery of a tubular jacket (64) enclosing a core (65) fitted with radial walls in order to divide in a watertight fashion the internal space of the said jacket into several chambers: a main chamber (66) and at least one secondary chamber capable of using one or several complementary nozzles, which core (65) is fitted with internal ducts connected to the pressurised water systems in order to feed each chamber at its lower portion thus enabling total drainage of these chambers once the installation has stopped.

11. A nucleation device according to claim 10, characterised in that it comprises a cartridge (92) arranged on the plane of a row of nozzles (75) for seeding each row, or a cartridge (92') arranged on the middle plane of the dihedron delineated by two rows of nozzles (75) for direct seeding of each row via two tips (93') oriented parallel and with respect to each face of the said dihedron.

12. A nucleation device according to claim 10, characterised in that the cartridge (92, 92') goes through the main chamber (66) and is shrink-fitted into the central core (65) leading to the pressurised air supply duct (95).

* * * * *